US007288011B2

(12) United States Patent
Ganley

(10) Patent No.: US 7,288,011 B2
(45) Date of Patent: Oct. 30, 2007

(54) PERSONAL FLOATATION DEVICE

(76) Inventor: John G. Ganley, 2211 S. 9th St., Minneapolis, MN (US) 55404

( * ) Notice: Subject to any disclaimer, the term of this patent is extended or adjusted under 35 U.S.C. 154(b) by 12 days.

(21) Appl. No.: 11/172,580

(22) Filed: Jun. 30, 2005

(65) Prior Publication Data

US 2007/0004298 A1 Jan. 4, 2007

(51) Int. Cl.
*B63C 9/08* (2006.01)

(52) U.S. Cl. ..... 441/106; 441/114; 441/117

(58) Field of Classification Search ..... 441/88, 441/102–119; 2/DIG. 3, 67, 69, 102, 108, 2/462–467

See application file for complete search history.

(56) References Cited

U.S. PATENT DOCUMENTS

| | | | | |
|---|---|---|---|---|
| 715,938 A | | 12/1902 | Armstrong | |
| 1,252,842 A | | 1/1918 | Richardson | |
| 1,272,336 A | * | 7/1918 | Edmonds | 441/112 |
| 1,500,665 A | | 7/1924 | Blankenhagen | |
| 1,508,274 A | | 9/1924 | Mattia | |
| 1,647,677 A | | 11/1927 | Weeks | |
| 1,657,866 A | * | 1/1928 | Mooney | 2/462 |
| 2,226,564 A | * | 12/1940 | Kienitz | 441/112 |
| 2,363,639 A | * | 11/1944 | Brown | 441/112 |

(Continued)

FOREIGN PATENT DOCUMENTS

JP 08230778 A * 9/1996

(Continued)

*Primary Examiner*—Ajay Vasudeva
(74) *Attorney, Agent, or Firm*—Crompton, Seager & Tufte LLC

(57) ABSTRACT

Personal floatation devices for use in supporting an individual in a face up and horizontal position along the surface of the water are disclosed. An illustrative personal floatation device may include a main body, at least one upper inflatable floatation member for providing floatation support to an upper section of the main body, at least one lower inflatable flotation member for providing floatation support to a lower section of the main body, and inflation means for selectively inflating each of the one or more upper and/or lower inflatable floatation members. The personal floatation device can be configured to provide floatation support to the individual's upper and lower torso as well as to the hip section and buttocks. The personal floatation device may provide buoyancy sufficient to orient the individual in a face up and horizontal position while also stabilizing the individual within the water.

26 Claims, 10 Drawing Sheets

U.S. PATENT DOCUMENTS

| | | | | | |
|---|---|---|---|---|---|
| 2,563,966 | A | * | 8/1951 | Shaw | 441/116 |
| 2,629,117 | A | * | 2/1953 | Frieder et al. | 441/116 |
| 2,692,994 | A | * | 11/1954 | King et al. | 441/110 |
| 2,893,020 | A | * | 7/1959 | Miller | 441/116 |
| 3,015,115 | A | * | 1/1962 | Medin | 441/115 |
| 3,050,753 | A | | 8/1962 | Baker | |
| 3,570,030 | A | * | 3/1971 | Baker | 441/116 |
| 3,931,657 | A | * | 1/1976 | Jones | 441/116 |
| 4,097,947 | A | * | 7/1978 | Kiefer | 441/116 |
| 4,276,670 | A | | 7/1981 | Marchello et al. | |
| 4,578,042 | A | * | 3/1986 | Evert | 441/117 |
| 4,623,316 | A | | 11/1986 | Ratliff | |
| 4,871,338 | A | | 10/1989 | Hoffman | |
| 4,917,641 | A | * | 4/1990 | Katoh et al. | 441/115 |
| 5,013,271 | A | | 5/1991 | Bartlett | |
| 5,030,153 | A | | 7/1991 | Bailey | |
| 5,152,706 | A | * | 10/1992 | Fister | 441/106 |
| 5,324,221 | A | | 6/1994 | Kaufman et al. | |
| 5,664,981 | A | | 9/1997 | Lillo | |
| 5,746,632 | A | | 5/1998 | Theberge | |
| 5,775,967 | A | * | 7/1998 | Lacoursiere et al. | 441/115 |
| 6,213,832 | B1 | | 4/2001 | Fest, Sr. | |
| 6,260,199 | B1 | | 7/2001 | Grunstein et al. | |
| 6,279,162 | B1 | | 8/2001 | Silverthorn | |
| 6,447,353 | B1 | * | 9/2002 | Henry | 441/106 |
| 6,478,647 | B1 | | 11/2002 | Matthews | |
| 6,551,161 | B2 | * | 4/2003 | Chern et al. | 441/124 |
| 6,659,824 | B1 | | 12/2003 | McCormick | |
| 6,805,519 | B1 | | 10/2004 | Courtney | |
| 2002/0002020 | A1 | | 1/2002 | Deslauriers | |

FOREIGN PATENT DOCUMENTS

| | | | | |
|---|---|---|---|---|
| JP | 2001233289 | A | * | 8/2001 |
| JP | 2003200887 | A | * | 7/2003 |

* cited by examiner

PERSONAL FLOATATION DEVICE

FIELD

The present invention relates generally to the field of personal floatation devices. More specifically, the present invention pertains to personal floatation devices for use in floating individuals in a face up and horizontal position along the surface of the water.

BACKGROUND

Water therapy is becoming an increasingly popular alternative in the field of physical therapy for providing a low-impact and yet effective form of exercising without the harmful effects typically associated with more rigorous activities such as running or jogging. In the treatment of rheumatoid arthritis, for example, water therapy has been used to build endurance and strength, ease stiff joints, and relax sore muscles. As water buoyancy tends to greatly reduce the pressure exerted on joints and muscles, such techniques have also been successfully used to treat other medical conditions such as fibromyalgia or polymyalgia rheumatica (PMR), making it easier for individuals suffering from such conditions to perform a needed range of motion exercise. While water therapy is particularly popular as a means of exercise for the disabled and/or for individuals suffering from certain medical conditions, such therapeutic techniques are equally applicable as a form of aquatic exercise for the general public, and may serve other purposes such as recreation, meditation, and/or closeness to God.

In certain types of water therapy such as aquatic exercise or swimming, it is often desirable for the individual's body to float in a face up and horizontal position along the surface of the water, allowing the individual to freely move on the surface of the water without having to exert energy to overcome the effects of gravity. To provide the necessary floatation for water therapy, a personal floatation device (PFD) may be worn to increase the individual's buoyancy within the water. Such personal floatation devices are available in a variety of configurations based on their intended use as well as the size and age of the individual. Other considerations such as heat retention, wetness, and drag may also play a role in the configuration of the personal floatation device.

To differentiate the types of personal floatation devices available, the United States Coast Guard has adopted a classification system rating such devices based on their buoyancy and intended use. A personal floatation device having a "Type I" rating, for example, indicates that the device has over 22 pounds of buoyancy, and is capable of overturning an unconscious individual within the water. A personal floatation device having a "Type III" rating generally indicates a device having a lower buoyancy rating (e.g. 15.5 pounds), often without the ability to overturn an unconscious individual within the water. Because Type I devices are generally designed to maintain the individual in an upright (i.e. face-up) position on the surface of the water, and typically have a greater amount of buoyancy, such devices tend to comprise a life-jacket or vest-type structure whereas Type III devices usually comprise floatation aids that are slipped over the head of the individual. Variations do exist, however.

Despite the many health and recreational benefits associated with water therapy, many conventional personal floatation devices are ill equipped for supporting users in a face up and horizontal position along the surface of the water while also permitting significant freedom of movement. As many personal floatation devices are designed to support the user in a vertical orientation (i.e. with the head up and feet down), such devices are not useful in those water therapy applications where a horizontal orientation is desired. Of those devices capable of orienting the user in both a face up and horizontal position along the surface of the water, such devices tend to be cumbersome to don and wear, making such devices unsuitable for use by certain individuals such as the disabled or elderly. In some cases, the personal floatation device may not adequately compensate for the individual's lower center of gravity, preventing the individual from fully floating on the surface of the water in a stable manner. Furthermore, and in other cases, the personal floatation device may lack the ability to automatically orient the individual in a particular direction within a moving body of water, forcing the individual to exert energy to maintain their bearing within the water.

SUMMARY

The present invention relates to personal floatation devices for use in floating individuals in an upright (ie. face-up) and horizontal position along the surface of the water. A personal floatation device in accordance with an illustrative embodiment of the present invention may include main body having a front side, a rear side, an upper section, and a lower section. The upper section of the main body may include a neck opening and a number arm openings and/or sleeves that receive the wearer's arms. The lower section of the main body, in turn, is adapted to lie at least in part below the individual's waistline, and can be secured to the individual using a drawstring feature. The personal floatation device can be configured as a floatation jacket, or may assume other configurations such as a life-vest or a full body suit, if desired.

The personal floatation device may be equipped with a number of floatation members that can be used to provide buoyancy to the individual's upper and lower torso as well as to the hip section and buttocks. A number of upper floatation members positioned adjacent to the neck opening of the main body can be used to provide floatation support for the wearer's upper torso, head, and neck. In similar fashion, a number of lower floatation members positioned adjacent to the individual's front and hip sections can be used to provide floatation support for the individual's lower torso, hip section, and buttocks. In certain embodiments, the upper and/or lower floatation members may be independently inflatable, allowing the individual to adjust their orientation and/or amount of submersion within the water.

In use, the upper and lower floatation members provide buoyancy sufficient to automatically float the individual in a fully upright and horizontal position along the surface of the water. The floatation members may also act to stabilize the individual, preventing disturbances such as wakes or ripples from overturning the individual within the water. Where a moving flow of water is present, the personal floatation device can also be configured to orient the individual in a feet-first position downstream in the water.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized. While a jacket-like structure is specifically depicted in illustrative embodiments herein, it should be understood that the personal floatation device may assume other configurations such as a life-vest or full body-suit, if desired.

Figure 1:
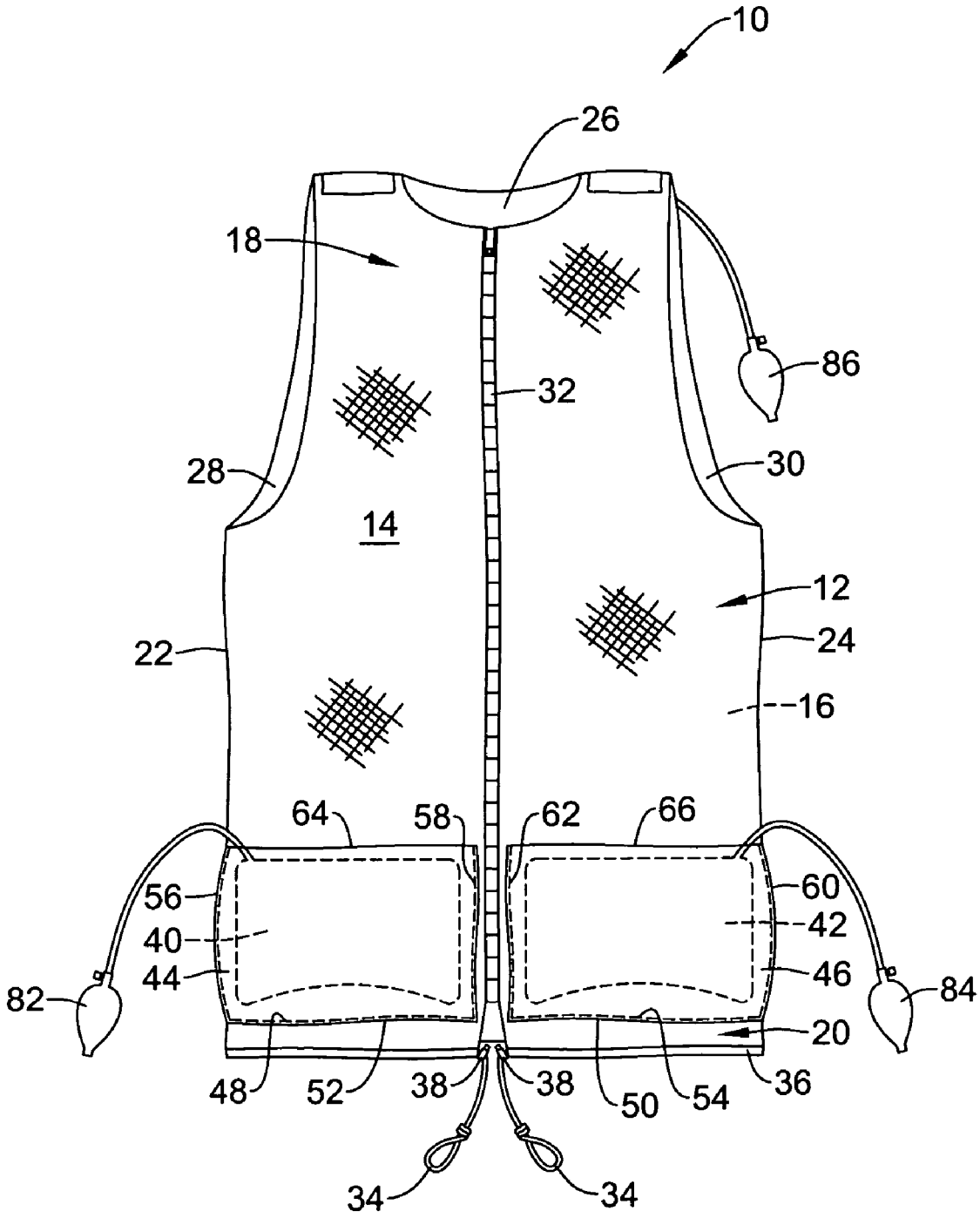
FIG. 1 is a front perspective view of an illustrative personal floatation device in accordance with an exemplary embodiment of the present invention.

FIG. 1 is a front perspective view of an illustrative personal floatation device 10 in accordance with an exemplary embodiment of the present invention. Device 10, illustratively a floatation jacket adapted to be worn by an individual such as an adult or child, may include a main body 12 having front side 14, a rear side 16, an upper section 18, a lower section 20, and a number of side sections 22,24, which together form a structure that can be used to float an individual in a fully upright (i.e. face-up) and horizontal position along the surface of the water.

The upper section 18 of the device 10 is adapted to fit about the upper torso of the wearer, and may include a neck opening 26 and a number of arm openings 28,30 that can be configured to fit about the wearer's neck and arms. The lower section 20 of the device 10, in turn, may extend below the wearer's midriff and waistline, and can be secured to the wearer's body using a drawstring feature or other suitable fastener means, as is described in greater detail below.

The main body 12 can have a unitary construction formed from a single construction member or from multiple members, and can be sized to fit any number of different types (e.g. tall, short, big, small, adult, infant, etc.) of individuals. In certain embodiments, for example, the main body may be provided as one size fits all, which can be adjusted by the appropriate selection of elastic materials to permit the main body 12 to expand or contract, as needed, in order to conform to the general shape of the wearer. Alternatively, and in other embodiments, the main body 12 may be provided in a number of different sizes (e.g. "S", "M", "L", "XL", "XXL", etc.). While a jacket configuration is specifically depicted in the illustrative embodiment of FIG. 1, other configurations such a life vest or full body suit are also contemplated.

A zipper 32 or other suitable fastener means located along the front side 14 of the device 10 can be used to secure each of the sides 22,24 together, providing a snug fit about the wearer. A drawstring 34 located along the lower periphery 36 of the main body 12 can be used to adjust the size of the lower section 20 to a desired fit, thus securing the main body 12 to the wearer at a location at or below the individual's waistline. A number of cinch locks 38 can be used to secure the drawstring 34 in place, once tightened. Other means for securing the main body 12 to the wearer such as a fabric hook or loop (e.g. Velcro), D-rings, ties, buckles, snaps, and/or buttons could also be used in addition to, or in lieu of, the drawstring 34. In some embodiments, a belt may be worn around the lower section 20 of the main body 12 to further secure the device 10 to the user, if desired.

The device 10 may have a sleeveless configuration to provide the wearer with greater arm mobility within the water. Alternatively, and in other embodiments, the device 10 may have a sleeved configuration with sleeves attached to and extending outwardly from the arms openings 28,30 to cover all or a portion of the wearer's arms. In some embodiments, the sleeves could be removably attached to the upper section 18 of the main body 12, allowing the wearer to alternate between a sleeved and sleeveless configuration, if desired. In some embodiments, the device 10 may also have a reversible feature that allows the main body 12 to be worn inside out, or which can be rolled or folded in order to convert the device 10 into a different configuration such as a life vest.

The main body 12 can be fabricated from a durable material or materials capable of withstanding repeated use of the device 10 while also being lightweight and flexible to permit the wearer to freely move within the water. The jacket material may comprise a natural material, a synthetic material, or a combination of both. Examples of suitable materials may include, but are not limited to Nylon, Neoprene, cotton, polyester, spandex, canvass, or combinations thereof. Other materials commonly used in the fabrication of personal floatation devices or bathing suits may also be utilized. Typically, the jacket material will comprise a porous material, allowing the main body 12 to breath when worn in the water, and which facilitates quicker drying times during periods of nonuse. Alternatively, and in other embodiments, the jacket material may comprise a relatively non-porous (i.e. less breathable material) such as silicon rubber or vinyl, which may be used to reduce drag and water retention in certain applications.

The color and/or texture of the jacket material may vary depending on the intended use of the device 10. If, for example, the device 10 is to be worn for recreational use, then the jacket material may have a visually appealing color and/or texture. For those applications where the device 10 is intended to be worn as a safety apparatus, the jacket material may have an orange or other easily spotted color, and can be configured to give off ultraviolet light for improved detection at night.

The device 10 can be sewn together along designated seam lines using a sturdy thread. The device 10 may be constructed from multiple layers of material, having an inner web and an outer web that can be assembled together in overlying relationship and sewn around the respective dimensions to define the general shape of the main body 12. The device 10 can be fabricated without an internal frame or ribbings, allowing the main body 12 to better conform to the shape of the wearer for improved comfort. In use, the absence of any straps attaching the main body 12 to the wearer's body also helps to reduce the complexity associated with putting on and/or adjusting the device 10. This ability to easily don and wear the device 10 is of particular importance to individuals such as the disabled or elderly, who may not have the dexterity or coordination necessary to operate many conventional devices having such features.

The front side 14 of the main body 12 can include a number of lower floatation members 40,42 that can be selectively inflated to provide buoyancy for the wearer's lower torso, hip section, and buttocks. The floatation members 40,42, which are hidden but shown generally by dashed lines in FIG. 1, may each include an inflatable bladder, foam pad insert (e.g. foamed polyurethane), $CO_2$ cartridge, and/or other suitable means for imparting buoyancy to the device 10. In certain embodiments, for example, the floatation members 40,42 may each comprise an inflatable floatation member that can be manually or automatically inflated via an inflation mechanism. In one illustrative embodiment described in greater detail below with respect to FIG. 4, for example, the floatation members 40,42 may each include an inflatable bladder that can be manually inflated with an inflation bulb or cuff to adjust the amount of buoyancy provided by the device 10.

The floatation members 40,42 can each be configured to fit within a corresponding pocket 44,46 formed on the main body 12, and can be accessed from either the exterior or interior portion of the main body 12 via a zipper, fabric hook or loop (e.g. Velcro), D-rings, ties, buckles, snaps, buttons, or other suitable fastener. In some embodiments, the pockets 44,46 may have a tuck-under feature that permits the wearer to secure the floatation members 40,42 within the interior of the pocket 44,46 without the need for a separate fastener.

The pockets 44,46 may each comprise a piece of material attached to the exterior or interior of the main body 12 via a stitch line 48,50 that extends along the bottom portion 52,54 and sides 56,58,60,62 of each respective pocket 44,46, connecting the outer periphery of the pockets 44,46 to the jacket material forming the main body 12. An opening disposed along the top portion 64,66 of each pocket 44,46 can be configured to removably receive the floatation members 40,42 within the interior of the pocket 44,46. Alternatively, and in other embodiments, the floatation members 40,42 can be permanently received within the pockets 44,46. In such case, the stitching lines 48,50 may extend about the entire outer periphery of the pocket 44,46, sealing the floatation members 40,42 within the interior of the pocket 44,46. In some cases, the floatation members 40,42 may be formed integral with the main body 12, obviating the need for separate pockets altogether.

The number, size, and/or location of the floatation members 40,42 can be varied depending on the amount of buoyancy desired, the orientation of the wearer in the water, the amount of drag produced by the device 10, as well as other factors. Thus, while two floatation members 40,42 are shown coupled to the lower section 20 of the device 10 in FIG. 1, it should be understood that a greater or lesser number of floatation members could be utilized. In some cases, each of the floatation members 40,42 may include multiple such floatation members to provide a level of redundancy in case one floatation members fails to inflate. If, for example, one of the floatation members breaks or becomes otherwise inoperable, one or more of the other members can be inflated to supply the necessary buoyancy. Other factors such as the type of fluid or gas injected into the floatation members 40,42 can also be varied to alter the amount of buoyancy provided by the device 10.

In some embodiments, the device 10 can be equipped with a sensor that measures the presence of fluid surrounding the device 10, and then automatically inflates one or more of the floatation members 40,42 using a $CO_2$ cartridge or other suitable inflation source. For example, the sensor may comprise a resistive-type pressure sensor capable of detecting the presence of fluid adjacent the sensor by measuring displacement of a diaphragm or beam. An actuator valve in fluid communication with an inflation source (e.g. a $CO_2$ cartridge) and the floatation members 40,42 can be activated upon the sensing of fluid by the sensor, causing the floatation members 40,42 to automatically inflate when the wearer is immersed within the water.

Figure 2:
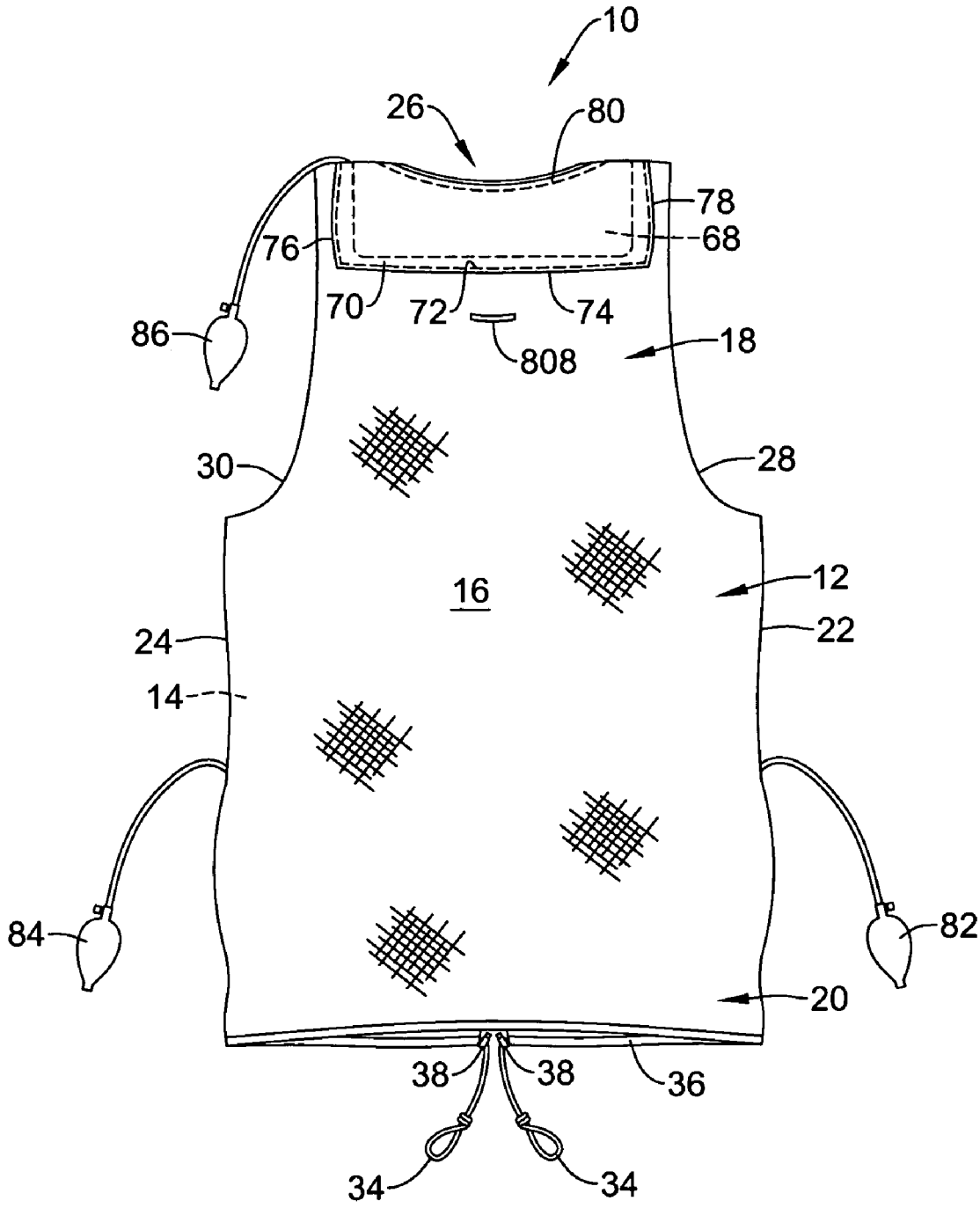
FIG. 2 is a rear perspective view of the illustrative floatation device of FIG. 1.

FIG. 2 is a rear perspective view showing the rear side 16 of the illustrative device 10 of FIG. 1. As shown in a deflated position in FIG. 2, the upper section 18 of the main body 12 may be further equipped with an upper floatation member 68 that can be used to provide floatation support for the wearer's upper torso, head and neck. As with the lower floatation members 40,42, the upper floatation member 68 can be formed integral with the main body 12, or, alternatively, can comprise a separate member that is attachable to the upper section 18 of the main body 12. In the latter case, for example, the floatation member 68 can be removably received within a separate pocket 70 located on the rear side 16 of the main body 12, allowing the user to remove the floatation member 68.

The pocket 70 may comprise a piece of material attached to the exterior or interior of the main body 12 via a stitch line 72 that extends along the bottom portion 74 and sides 76,78 of the pocket 70, connecting the outer periphery of the pocket 70 to the rear side 16 of the main body 12. An opening disposed along the top portion 80 of the pocket 70 can be configured to removably receive the floatation member 68 within the interior of the pocket 70. In some embodiments, the top portion 80 of the pocket 70 can have an arcuate shape that follows the general shape of the upper floatation member 68, which, as described below, can be configured to contour about the wearer's neck. A zipper, fabric hook or loop (e.g. Velcro), D-rings, ties, buckles, snaps, buttons or other suitable fastener means may be provided on the top portion 80 of the pocket 70, allowing the user to remove the floatation member 68. Alternatively, the pocket 70 may have a tuck-under feature that permits the wearer to secure the floatation member 68 within the interior of the pocket 70 without the need for a separate fastener.

As can be further seen in FIGS. 1 and 2, a separate inflation mechanism 82,84,86 such as an inflatable bulb or cuff may be provided to selectively inflate each of the lower and upper floatation members 40,42,68 independent of each other. A number of lower inflation mechanisms 82,84 can be used to adjust the amount of floatation provided to the wearer's lower torso, hips, and buttocks via the lower floatation members 40,42. In similar fashion, an upper inflation mechanism 86 can be used to adjust the amount of floatation provided to the wearer's upper torso, head, and neck vis-á-vis the upper floatation member 68. In some cases, for example, the inflation mechanism 86 can be used to adjust the amount of buoyancy provided by the device 10 so that more of less of the wearer's head is positioned above the surface of the water, or so that the wearer's body is oriented at a particular angle relative to the surface of the water. If, for example, the wearer is a child whose head is disproportionately larger than their body, the inflation mechanism 86 can be used to provide a greater amount of floatation to the child's upper body to maintain the child's head above the water.

While the lower and upper floatation members 40,42,68 may each include a separate inflation mechanism that permits the floatation members 40,42,68 to be selectively inflated by the user, it should be understood that a single inflation mechanism capable of inflating multiple floatation members 40,42,68 could be utilized. In certain embodiments, for example, a single inflation mechanism can be used to inflate each of the lower floatation members 40,42 while a separate inflation mechanism could be used to inflate the upper floatation member 68. A singe inflation mechanism capable of inflating all of the floatation members 40,42,68 could also be used, if desired.

Figure 3:
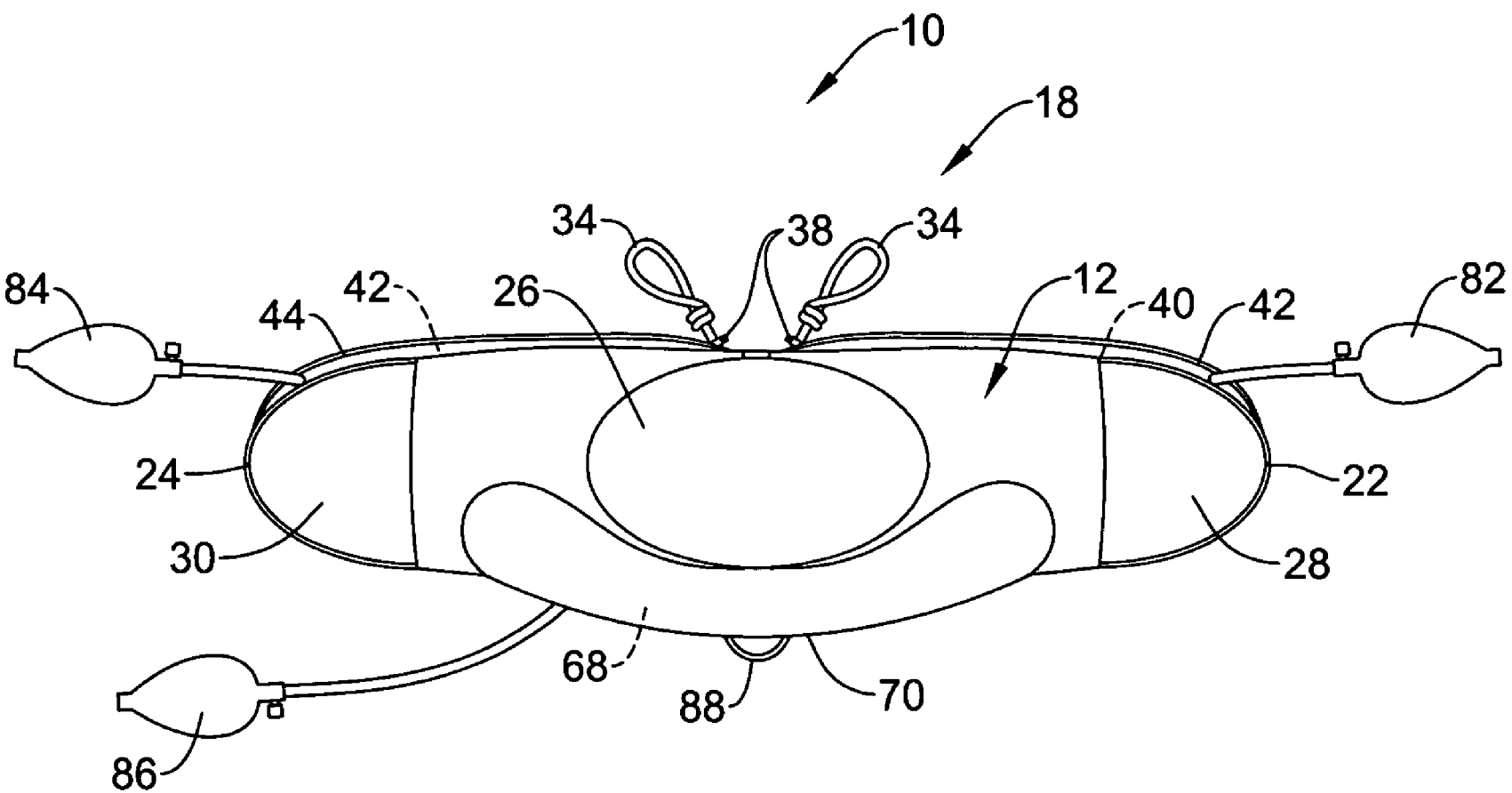
FIG. 3 is a top perspective view of the illustrative personal floatation device of FIG. 1.

FIG. 3 is a top perspective view showing the upper section 18 of the illustrative personal floatation device 10 of FIG. 1 in greater detail. As can be seen by reference to FIGS. 2 and 3, the upper floatation member 68 may extend lengthwise along a significant portion of the width of the main body 12 defined by sides 22 and 24. When fully inflated, the floatation member 68 may expand and assume a substantially U-shaped configuration, which wraps around the wearer's neck in the shape of a horseshoe. In use, such U-shaped configuration serves to cradle the wearer's neck while also allowing the wearer to easily move their head back and forth within the water. If desired, a tow loop or hook 88 located on the rear side 16 of the main body 12 can be used to secure the device 10 to an optional tow line.

Figure 4:
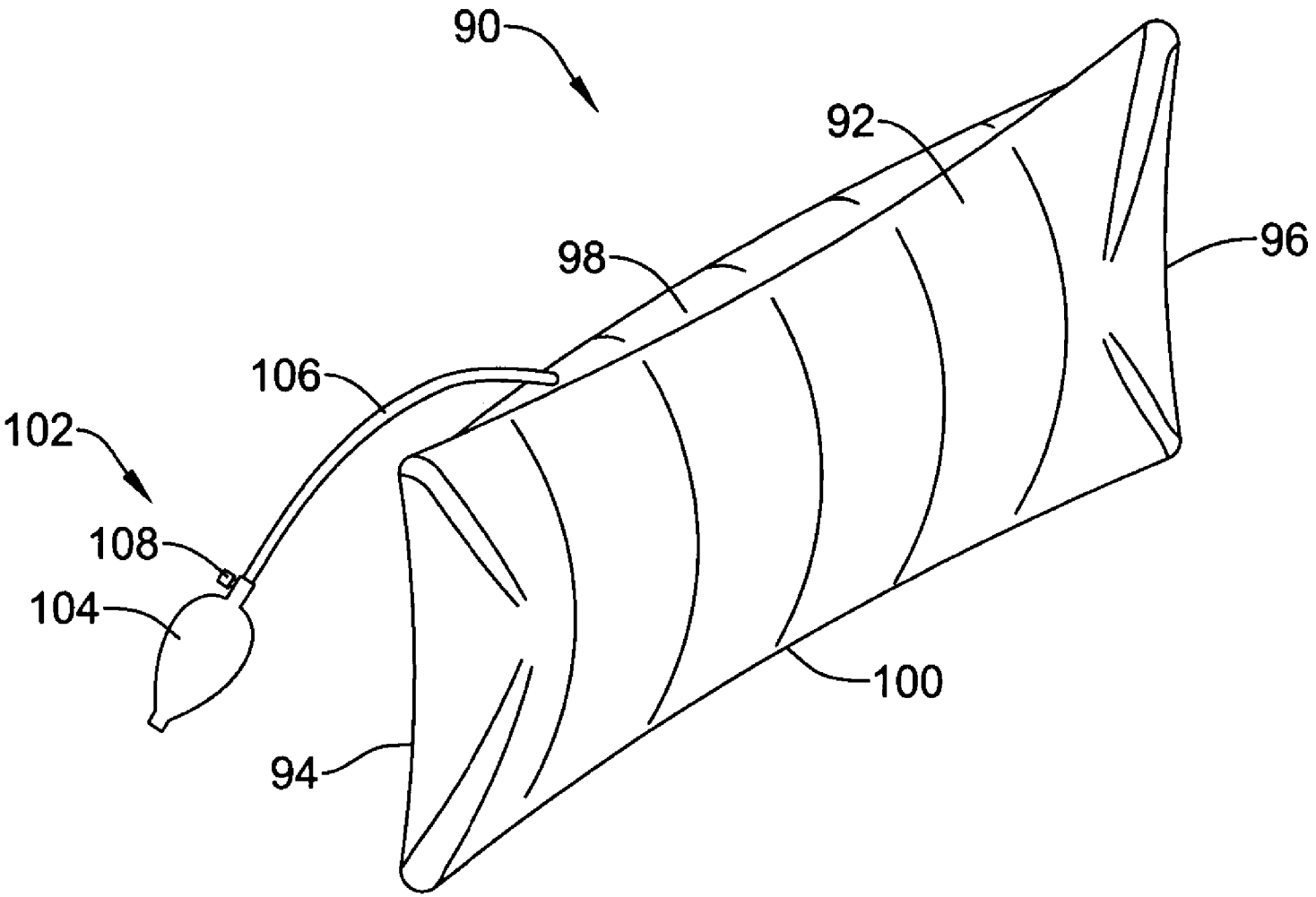
FIG. 4 is a perspective view showing an illustrative floatation member for use with the personal floatation device of FIG. 1.

FIG. 4 is a perspective view showing an illustrative floatation member 90 for use with the personal floatation device 10 of FIG. 1. As shown in an inflated position in FIG. 4, the floatation member 90 may comprise an inflatable bladder 92 having a first side 94, a second side 96, a first end 98, and a second end 100. The inflatable bladder 92 may be formed from an elastic material that permits the inflatable bladder 92 to distend when inflated with a fluid or gas. Examples of suitable materials for the inflatable member 92 may include, but are not limited to inflatable plastic, vinyl, or rubber. In some embodiments, the elasticity of the inflatable bladder 92 can be matched with the elasticity of the jacket material, allowing the inflatable bladder 92 to better conform to the shape of the wearer's body. The ability of the device 10 to flexibly conform to the shape of the wearer prevents the device 10 from slipping on the wearer's body, and may improve the comfort of the device 10.

An inflation mechanism 102 including an inflation bulb or cuff 104 and a fluid line 106 can be used to selectively inflate or deflate the inflatable bladder 92 to adjust the amount of buoyancy provided by the device 10. A valve 108 such as a bleed valve operatively coupled to the fluid line 106 can be used to evacuate air or other fluid contained within the inflatable bladder 92 to reduce the amount of buoyancy provided by the device 10, and to permit the device 10 to be collapsed to a relatively small size during periods of nonuse. The valve 108 may be located adjacent to the inflatable bulb or cuff 104, the inlet of the fluid line 106 into the inflatable bladder 92, or at some other desired location.

Figure 5:
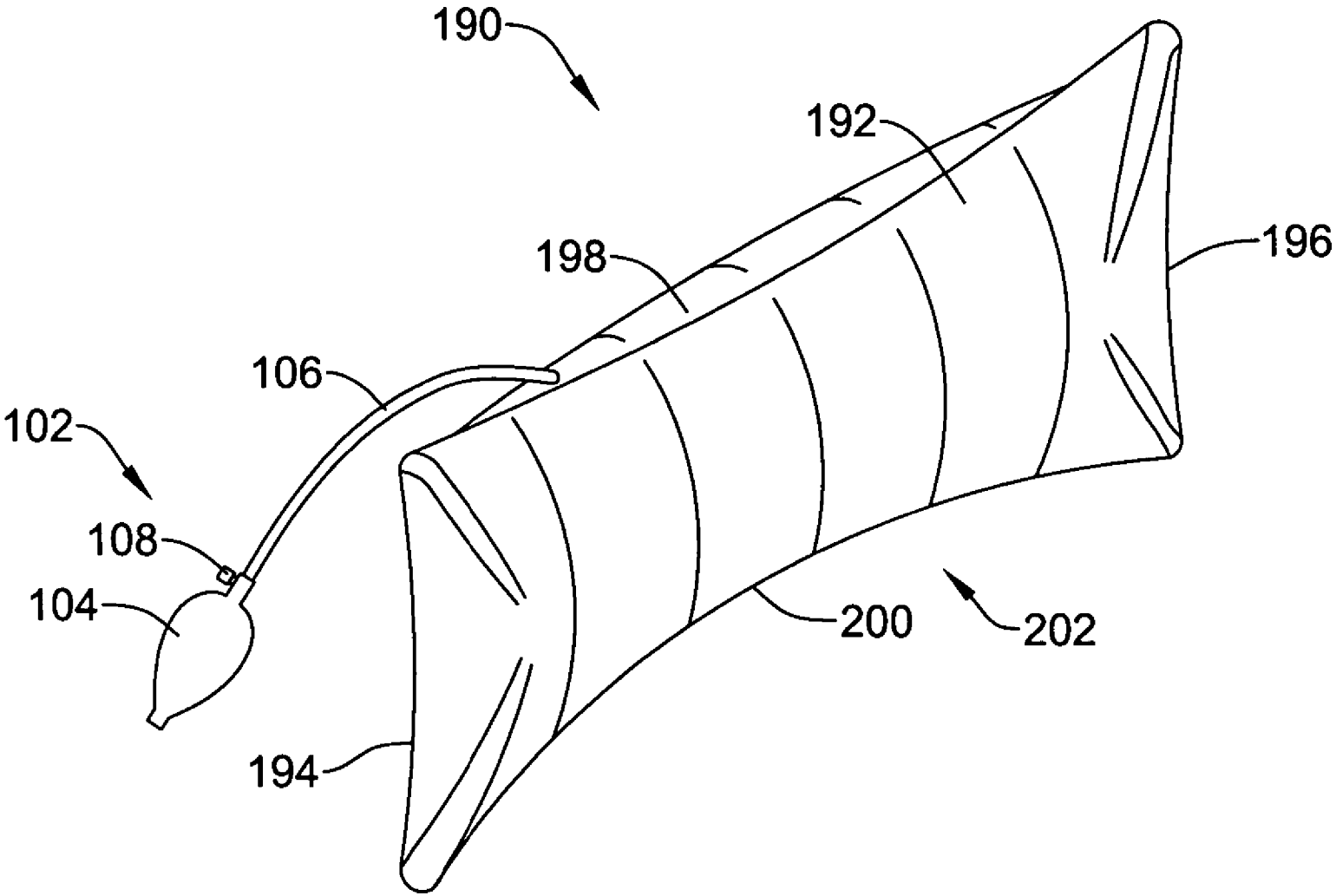
FIG. 5 is a perspective view showing another illustrative floatation member for use with the personal floatation device of FIG. 1.

FIG. 5 is a perspective view showing another illustrative floatation member 190 for use with the personal floatation device 10 of FIG. 1. As shown in an inflated position in FIG. 5, the floatation member 190 may comprise an inflatable bladder 192 having a first side 194, a second side 196, a first end 198, and a second end 200. The floatation member 190 can be configured similar to the floatation member 90 described above with respect to FIG. 4, with like elements labeled in like fashion.

In the illustrative embodiment of FIG. 5, however, the second (i.e. lower) end 200 of the inflatable bladder 192 may have an arcuate shape that extends along a portion of the inflatable bladder 192 from the first side 194 to the second side 196 thereof, forming an indented region 202 that contours to the general shape of the wearer's hip section when used as a lower floatation member. The indented region 202 may also serve to maintain the lower section 20 of the floatation device 10 snug against the wearer's body, providing greater stability and comfort.

Figure 6:
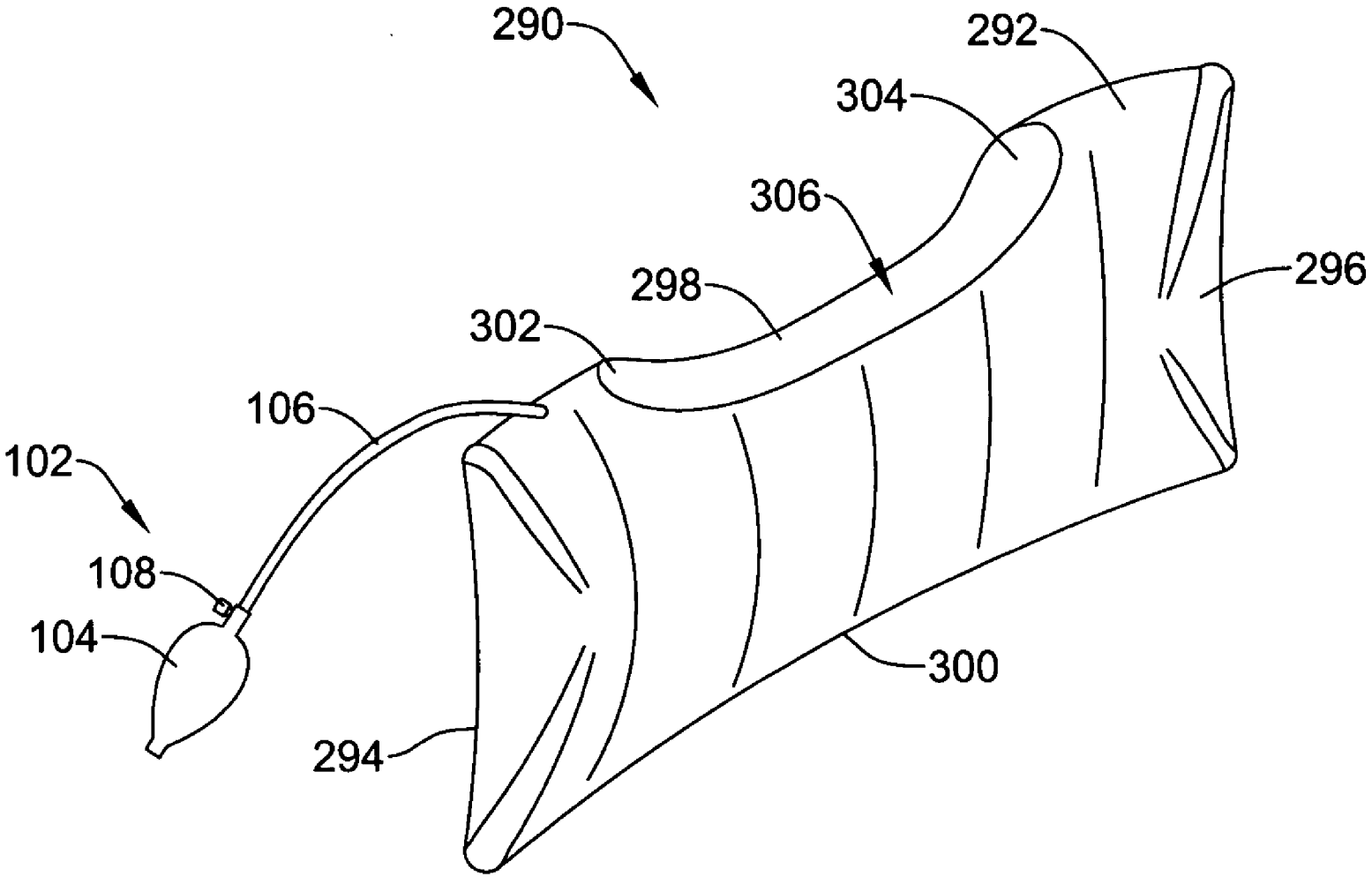
FIG. 6 is a perspective view showing another illustrative floatation member for use with the personal floatation device of FIG. 1.

FIG. 6 is a perspective view showing another illustrative floatation member 290 for use with the personal floatation device 10 of FIG. 1. As shown in an inflated position in FIG. 6, the floatation member 290 may comprise an inflatable bladder 292 having a first side 294, a second side 296, a first end 298, and a second end 300. The floatation member 290 can be configured similar to the floatation member 90 described above with respect to FIG. 4, with like elements labeled in like fashion.

In the illustrative embodiment of FIG. 6, however, the first (i.e. upper) end 198 of the inflatable bladder 292 may have an arcuate shape that extends along a portion of the inflatable bladder 292 from a first location 302 to location 304 thereon, forming an indented region 306 that provides greater floatation support to the sides of the wearer's neck and head when used as an upper floatation member. In addition, and as further shown in FIG. 6, the inflatable bladder 292 may also have a generally arcuate or bent configuration along all or a portion of its length, causing the inflatable bladder 292 to bow inwardly and wrap around a portion of the wearer's neck when used as an upper floatation member.

Figure 7:
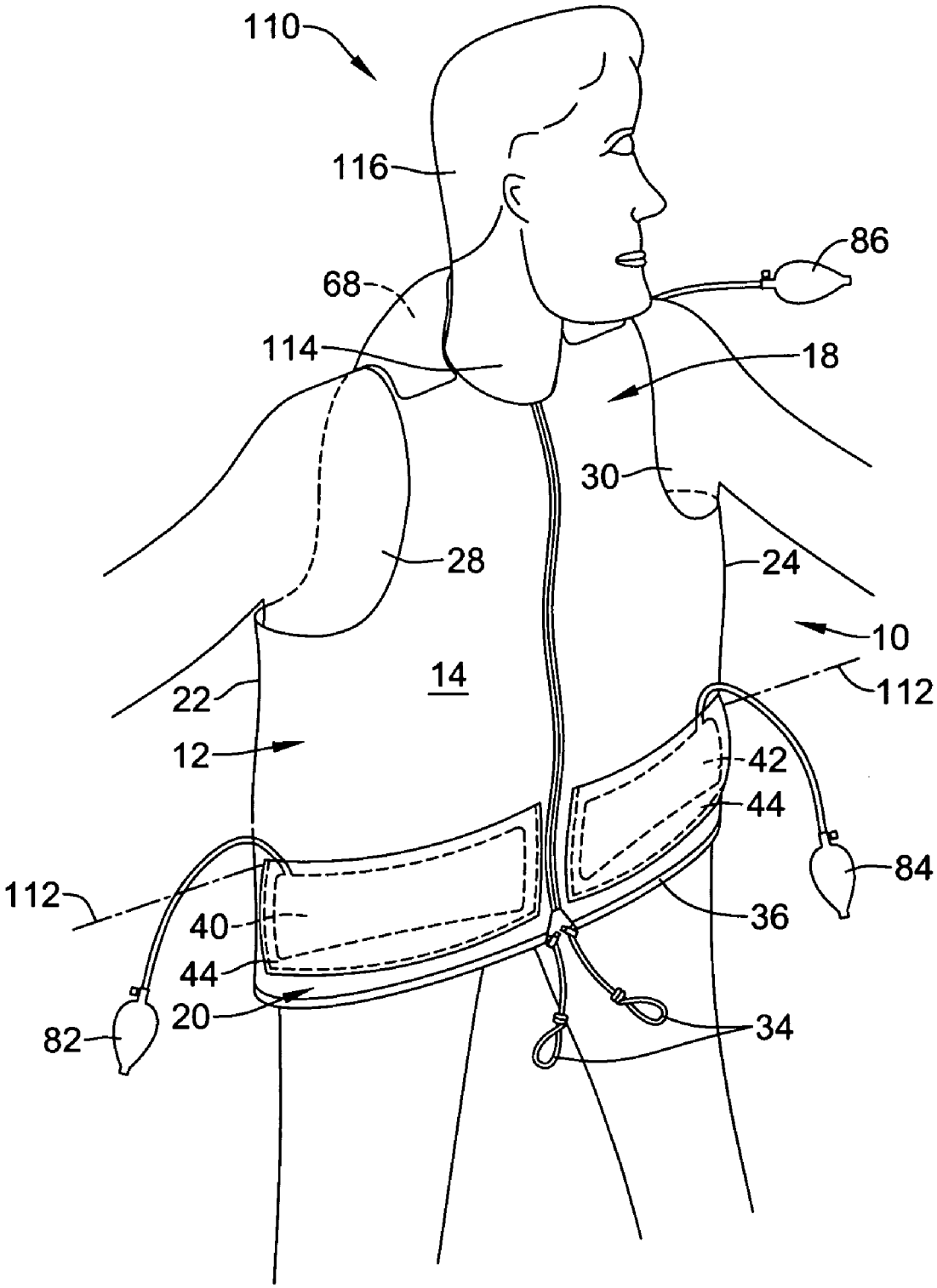
FIG. 7 is a front perspective view showing an individual wearing the illustrative personal floatation device of FIG. 1.
Figure 8:
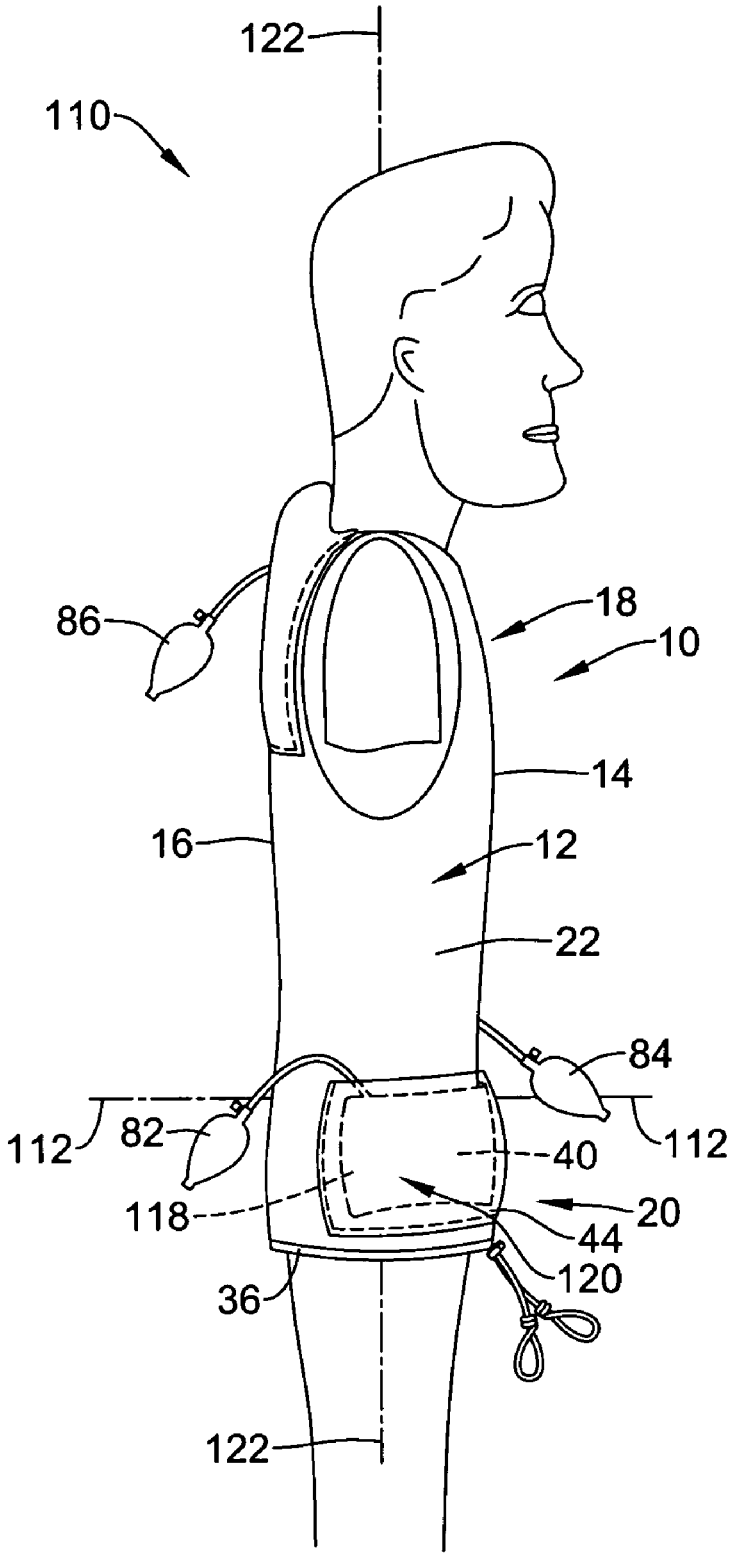
FIG. 8 is a side perspective view showing an individual wearing the illustrative personal floatation device of FIG. 1.

FIGS. 7-8 are front and side perspective views, respectively, showing an individual 110 wearing the illustrative personal floatation device 10 of FIG. 1. As can be seen in FIGS. 7 and 8, the upper section 18 of the main body 12 can be configured to lie fat or flush with the individual's upper torso, with the arms extending freely through the arm cutouts 28,30. The lower section 20 of the main body 12, in turn, can be configured to extend downwardly to a position below the individual's waistline, which is demarcated generally by a transverse plane axis 112 dividing the individual's upper (i.e. superior) and lower (i.e. inferior) body sections. The lower periphery 36 of the main body 12 can extend to a location adjacent the individual's body at a position below the transverse plane axis 112, and can be secured thereto using the drawstring feature 34 described above with respect to FIG. 1.

When inflated, the upper floatation member 68 can be configured to expand and assume a substantially U-shaped configuration that wraps about a portion of the individual's neck 114, as shown. In certain embodiments, for example, the upper floatation member 68 can be biased to distend in a slight upward position towards the individual's neck 114, which serves to cradle the neck 114 while also allowing the individual 110 to easily move their head 116 back and forth within the water. If desired, the amount of buoyancy provided by the floatation member 68 may be adjusted via the inflation mechanism 82.

As can be further seen in FIGS. 7 and 8, the lower floatation members 40,42 can be positioned on the main body 12 adjacent the individual's waistline at a location at least in part below the transverse plane axis 112. The vertical positioning of the floatation members 40,42 at or below the individual's waistline is significant to permit the lower section of the individual's body to fully float on the surface of the water, as the center of gravity for most adults is usually located at or near this location (i.e. near the sacral promontory). The location of the lower floatation members 40,42 is thus lower on the individual's body than that of many conventional life vests, which are typically configured to support the individual in a vertical position within the water.

The sides 118 of the lower floatation members 40,42 located furthest away from the individual's 110 centerline may extend from the front side 14 of the main body 12 to a location on each side 22,24 thereof adjacent to the individual's hip section, providing additional floatation to the individual's hips and buttocks. As shown in FIG. 8, for example, the individual's right floatation member 40 can extend from the front side 14 of the main body 12 towards the right side 22 of the main body 12 to a location adjacent the individual's right hip section, indicated generally by reference arrow 120. A similar configuration can be provided for the individual's left hip section. In some embodiments, and as further shown in FIG. 8, at least a portion of the lower floatation members 40,42 may extend about the periphery of the main body 12 beyond a coronal or frontal plane axis 122 that separates the individual's anterior (i.e. frontal) and posterior (i.e. rear) body sections.

During use, the location of the lower floatation members 40,42 on the main body 12 as well as their general shape provides additional buoyancy and stability to the individual's hip section 120 and buttocks, which acts to stabilize the individual 110 within the water. In some cases, such additional buoyancy and stability may permit the individual 110 to steadily float on the surface of the water when wakes, ripples, or other such motion is present. For certain types of individuals such as the disabled and/or the elderly, for example, such configuration may permit the individual to fully float on the surface of the water without having to expend energy maintaining one's stability within the water.

Figure 9:
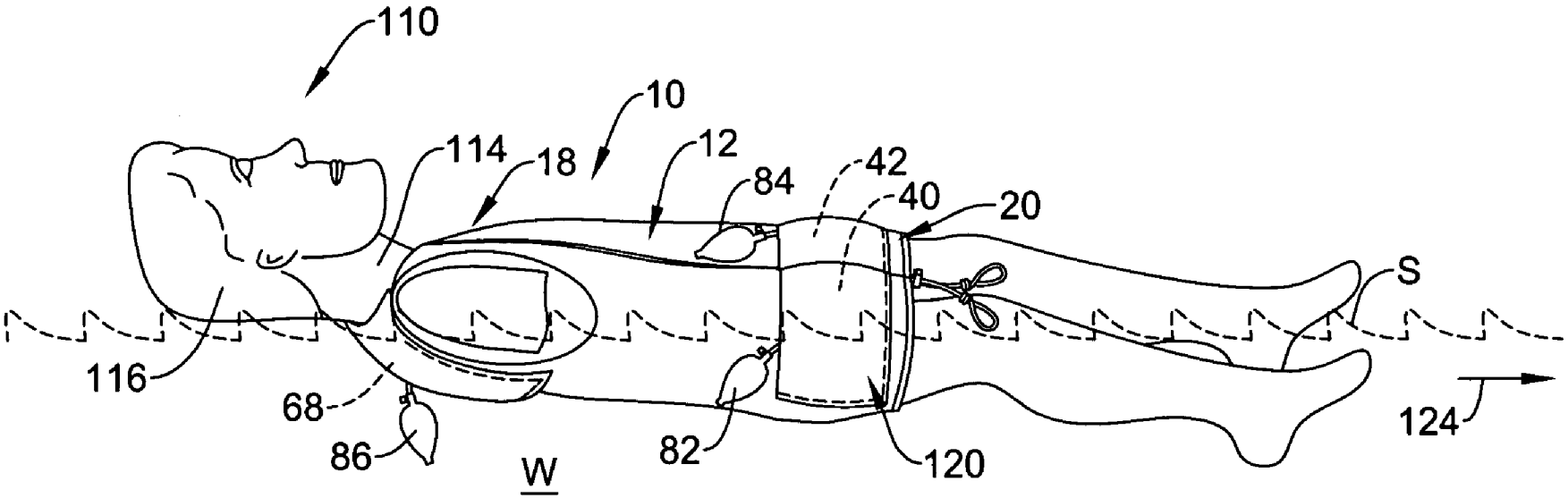
FIG. 9 is a schematic view showing the illustrative personal floatation device of FIG. 1 being used to support an individual in a face up and horizontal position along the surface of the water.

FIG. 9 is a schematic view showing the illustrative personal floatation device 10 of FIG. 1 being used to support an individual 110 along the surface S of the water W. As can be seen in FIG. 9, when the floatation members 40,42,68 are at least partially inflated, the device 10 can be configured to automatically support the individual's body in a face up (i.e. face up) and horizontal position along the surface S of the water W. The upper floatation member 68 may be separately inflated via inflation mechanism 86 to fully support the individual's upper torso, head and neck above the surface S. The lower floatation members 40,42, in turn, can each be separately inflated via inflation mechanisms 82,84 to fully support the individual's lower torso, hip section 120 and buttocks above the surface S. In use, the positioning of the lower floatation members 40,42 at a location below the individual's waistline and adjacent their hip section 120 acts to orient the individual's entire torso above the surface S of the water W, as shown.

If the individual 110 wishes to adjust the orientation of their body or head 116 within the water, the individual 110 may independently adjust one or more of the floatation members 40,42,68, as desired, using the appropriate inflation mechanism 82,84,86. If, for example, the individual 110 desires to submerge more of their lower torso within the water W, the user may depress the bleed valve on each of the lower floatation members 40,42 to decrease the buoyancy provided by the device 10 at this location. Conversely, if the individual 110 desires more of their head 116 to be submerged within the water W, the individual 110 may depress the bleed valve on the upper floatation member 68.

The side-to-side orientation of the individual 110 can be further adjusted by selectively inflating and/or deflating one or more of the floatation members 40,42,68. If, for example, the individual 110 wishes to float horizontally but at a slight angle to the right, the individual 110 may activate the bleed valve for the right-lower floatation member 40 while maintaining the current pressure within the left-lower floatation member 42. Conversely, if the individual 110 wishes to float horizontally but at a slight angle to the left, the individual 110 may activate the bleed valve for the left-lower floatation member 42 while maintaining the current pressure within the right-lower floatation member 40. Combinations of pressures within each of the floatation members 40,42,68 can be selected to provide a number of different body orientations within the water W, as desired. Ballasts, outriggers, or other such means for adjusting weight distribution can also be used to adjust the orientation of the individual's body within the water W, if desired.

In some applications, the configuration of the device 10, including the relative location of the upper and lower floatation members 40,42,68, may further act to orient the individual 110 in a feet-first position downstream within the water W. As shown in FIG. 9, the device 10 can be configured to orient the individual 110 in a feet-first position in the flow direction of the water W, indicated generally by reference arrow 124. The ability of the device 10 to orient the individual 110 in a feet-first position downstream in the water W provides the individual 110 with a better view of any obstructions within the water W, and reduces the amount of energy exerted to maintain their bearing within the water W.

Figure 10:
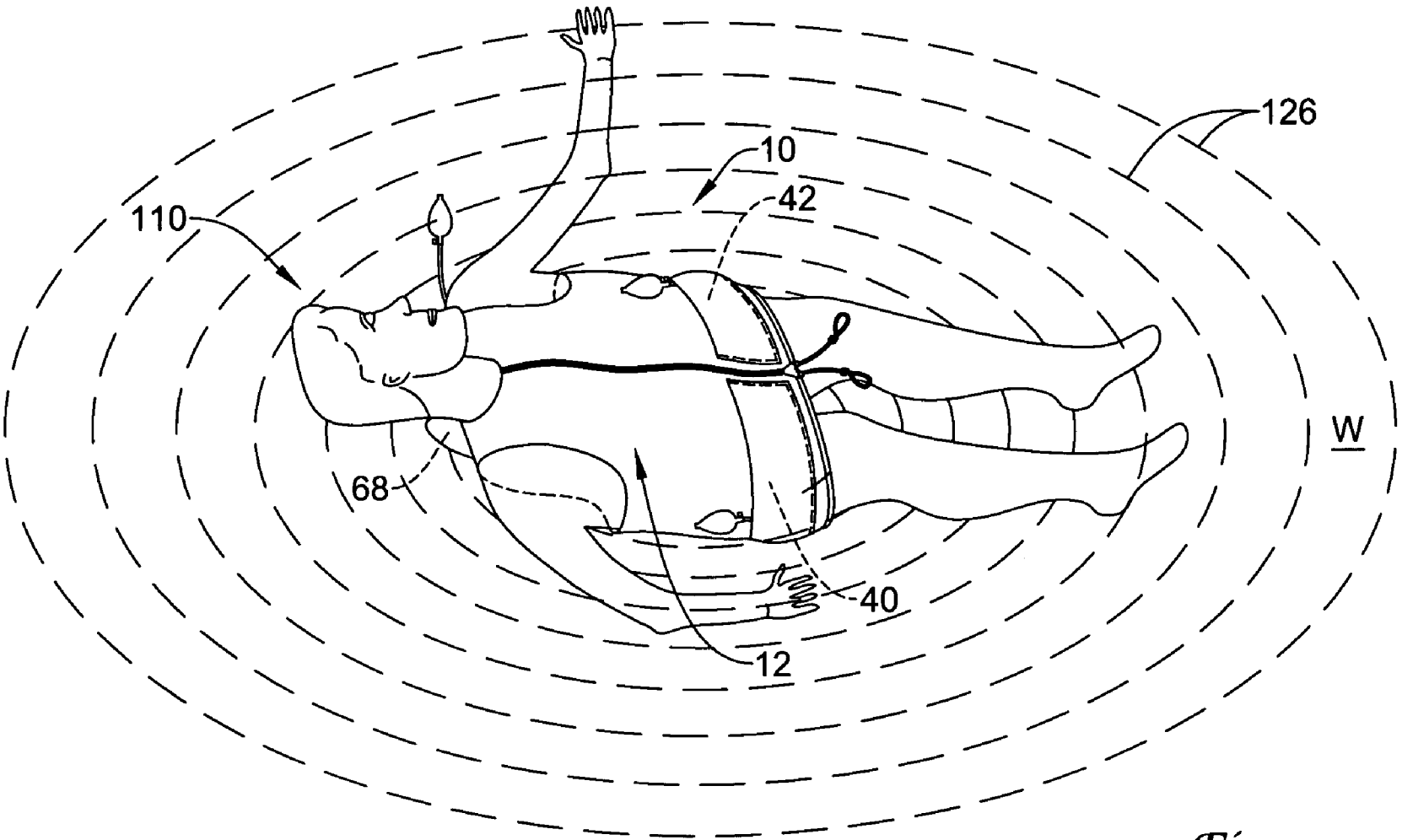
FIG. 10 is another schematic view showing the illustrative personal floatation device of FIG. 1 being used to support an individual in a face up and horizontal position along the surface of the water.

FIG. 10 is another schematic view showing the illustrative personal floatation device 10 of FIG. 1 being used to support an individual 110 in a face up and horizontal position along the surface S of the water W. As indicated generally by the concentric rings 126 in FIG. 10, small disturbances within the water W such as wakes or ripples can cause the water W to become unstable, producing forces on the individual 110 that can cause a change in the individual's 110 pitch (i.e. attitude) and/or yaw within the water W. If significant enough, such forces can create couple moments that can act to tip or roll the individual 110 towards one side (e.g. to the right or left) within the water W.

The use of multiple floatation members spaced apart from each other acts to counterbalance these moments, maintaining the individual's body at stable equilibrium. In some cases, the number and positioning of the floatation members may act to absorb those forces resulting from disturbances in the water, thus maintaining the user in a constant upright and horizontal position along the surface of the water W. The ability of the device 10 to fully float the individual's body above the surface of the water W also acts to lower the susceptibility to overturning within the water W. Because the personal floatation device 10 can be used to maintain the wearer in a fully upright position along the surface of the water, the wearer may use their arms, legs, or both when moving within the water.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. Changes may be made in details, particular in matters of size, shape, and arrangement of parts without exceeding the scope of the invention. It will be understood that this disclosure is, in many respects, only illustrative.

What is claimed is:

1. A personal floatation device for use in supporting an individual in a face up and horizontal position along the surface of the water, the personal floatation device comprising:

a main body having a front side, a rear side, an upper section including a neck opening and a number of arm openings and/or sleeves, and a lower section including attachment means adapted to secure the main body to the lower torso of the individual at a location at least in part below the waistline;

upper floatation means for providing floatation support to the upper section of the main body;

lower floatation means for providing floatation support to the lower section of the main body, the lower floatation means including a plurality of inflatable floatation members each extending lengthwise from the front side of the main body to a side portion thereof and being positioned adjacent to and adapted to provide floatation support for the hip section of the individual; inflation mechanism for inflating the lower floatation means; and wherein the personal floatation device is adapted to automatically orient the individual in a fully face-up and horizontal position along the surface of the water.

2. The personal floatation device of claim 1, wherein said personal floatation device is a floatation jacket.

3. The personal floatation device of claim 1, wherein said upper floatation means includes at least one upper floatation member coupled to the upper section of the main body at a location adjacent to said neck opening.

4. The personal floatation device of claim 3, wherein said at least one upper floatation member comprises an inflatable floatation member.

5. The personal floatation device of claim 4, wherein said upper inflatable floatation member comprises a U-shaped floatation member.

6. The personal floatation device of claim 5, wherein said U-shaped inflatable floatation member is biased to distend towards the neck opening of said upper section.

7. The personal floatation device of claim 4, wherein said upper inflatable floatation member includes an inflatable bladder in fluid communication with an inflation mechanism.

8. The personal floatation device of claim 1, wherein each of said lower inflatable floatation member includes an inflatable bladder in fluid communication with the inflation mechanism.

9. The personal floatation device of claim 8, wherein each of said lower inflatable floatation member is independently inflatable.

10. The personal floatation device of claim 1, wherein each of said lower inflatable floatation member includes an indented section adapted to contour to the hip section of said individual.

11. A personal floatation device for use in supporting an individual in a face up and horizontal position along the surface of the water, the personal floatation device comprising:

a main body having a front side, a rear side, an upper section including a neck opening and a number of arm openings and/or sleeves, and a lower section including attachment means adapted to secure the main body to the lower torso of the individual at a location at least in part below the waistline;

at least one upper inflatable floatation member for providing floatation support to the upper section of the main body;

plurality of lower inflatable flotation members for providing floatation support to the lower section of the main body, plurality of lower inflatable floatation members being spaced apart from the at least one upper inflatable floatation member along a longitudinal axis of the main body, the plurality of lower inflatable floatation members being further positioned adjacent to and adapted to provide floatation support for a hip section of the individual;

inflation means for inflating one or more of said at least one upper and lower inflatable floatation members; and wherein the personal floatation device is adapted to automatically orient the individual in a fully face-up and horizontal position along the surface of the water.

12. The personal floatation device of claim 11, wherein said personal floatation device is a floatation jacket.

13. The personal floatation device of claim 11, wherein said at least one upper inflatable floatation member comprises a U-shaped inflatable floatation member.

14. The personal floatation device of claim 13, wherein said U-shaped inflatable floatation member is biased to distend towards the neck opening of said upper section.

15. The personal floatation device of claim 11, wherein said plurality of lower inflatable floatation members extends lengthwise from the front side of the main body to a side portion thereof.

16. The personal floatation device of claim 11, wherein each of said plurality of lower inflatable floatation members includes an indented section adapted to contour to the hip section of said individual.

17. The personal floatation device of claim 11, wherein said inflation means includes one or more inflation mechanisms in fluid communication with an inflation fluid source.

18. The personal floatation device of claim 17, wherein each of said at least one upper and/or lower inflatable floatation members are selectively inflatable.

19. A personal floatation device for use in supporting an individual in a face up and horizontal position along the surface of the water, the personal floatation device comprising:

a main body having a front side, a rear side, an upper section including a neck opening and a number of arm openings and/or sleeves, and a lower section including attachment means adapted to secure the main body to the lower torso of the individual at a location at least in part below the waistline;

at least one upper inflatable floatation member for providing floatation support to the upper section of the main body;

a plurality of lower inflatable floatation members for providing floatation support to the lower section of the main body, the plurality of lower inflatable members being spaced apart from the at least one upper inflatable floatation member along a longitudinal axis of the main body, the plurality of lower inflatable floatation members being further positioned adjacent to and adapted to provide floatation support for a hip section of the individual;

inflation means for inflating one or more of said upper and lower inflatable floatation members; and wherein the personal floatation device is adapted to automatically orient the individual in a fully face-up and horizontal position along the surface of the water.

20. A floatation jacket for use with an individual, comprising:

a main body having a front side, a rear side, an upper section including a neck opening and a number of arm openings and/or sleeves, and a lower section including attachment means adapted to secure the main body to the lower torso of the individual at a location at least in part below the waistline;

at least one upper inflatable floatation member for providing floatation support to the upper section of the main body;

a plurality of lower inflatable floatation members for providing floatation support to the lower section of the main body, the plurality of lower inflatable members being spaced apart from the at least one upper inflatable floatation member along a longitudinal axis of the main body, the plurality of lower inflatable floatation members being further positioned adjacent to and adapted to provide floatation support for a hip section of the individual;

inflation means for inflating one or more of said upper and lower inflatable floatation members; and wherein the personal floatation device is adapted to automatically orient the individual in a fully face-up and horizontal position along the surface of the water.

21. The floatation jacket of claim 20, wherein said at least one upper inflatable floatation member comprises a U-shaped inflatable floatation member.

22. The floatation jacket of claim 21, wherein said U-shaped inflatable floatation member is biased to distend towards the neck opening of said upper section.

23. The floatation jacket of claim 20, wherein each of said plurality of lower floatation member extends lengthwise from the front side of the main body to a side portion thereof.

24. The floatation jacket of claim 20, wherein each of said plurality of lower inflatable floatation members includes an indented section adapted to contour to the hip section of said individual.

25. The floatation jacket of claim 20, wherein said inflation means includes one or more inflation mechanisms in fluid communication with an inflation fluid source.

26. The floatation jacket of claim 25, wherein each of said upper and/or lower inflatable floatation members are selectively inflatable.

* * * * *